US008662368B2

(12) United States Patent
Elliott

(10) Patent No.: US 8,662,368 B2
(45) Date of Patent: Mar. 4, 2014

(54) WEARABLE CAMERA LENS BAG AND LAPTOP BAG

(75) Inventor: Keats Elliott, Marina del Rey, CA (US)

(73) Assignee: Shootsac, Inc., Marina Del Rey, CA (US)

( * ) Notice: Subject to any disclaimer, the term of this patent is extended or adjusted under 35 U.S.C. 154(b) by 1229 days.

(21) Appl. No.: 12/253,863

(22) Filed: Oct. 17, 2008

(65) Prior Publication Data

US 2009/0101530 A1 Apr. 23, 2009

Related U.S. Application Data

(60) Provisional application No. 60/999,782, filed on Oct. 18, 2007.

(51) Int. Cl.
*B65D 85/38* (2006.01)
*A45F 5/00* (2006.01)

(52) U.S. Cl.
USPC ..... 224/653; 224/236; 224/610; 224/908

(58) Field of Classification Search
USPC ..... 224/908, 236, 607, 610, 681, 682, 257, 224/653; 383/118, 39; 150/104, 127, 103, 150/112; 206/316.1
See application file for complete search history.

(56) References Cited

U.S. PATENT DOCUMENTS 1,747,801 A * 2/1930 Topal ..... 150/104
2,009,077 A * 7/1935 Walitzky ..... 150/112
2,080,453 A * 5/1937 Kraut ..... 150/104
2,691,401 A 10/1954 Kontoff et al.
2,784,756 A * 3/1957 Resnick ..... 150/103
3,819,033 A * 6/1974 Hueber ..... 206/5
4,131,147 A * 12/1978 Schrage ..... 206/316.2
D258,702 S 3/1981 Weinreb
4,260,004 A 4/1981 Domke
D260,574 S 9/1981 Outcalt
4,330,073 A * 5/1982 Clark ..... 224/223
4,428,484 A * 1/1984 Rattay et al. ..... 206/548
D272,965 S 3/1984 Simon
D273,535 S 4/1984 Weinreb (Continued)

FOREIGN PATENT DOCUMENTS

DE 3431426 A1 * 7/1985
GB 2084866 A * 4/1982

*Primary Examiner* — Justin Larson
*Assistant Examiner* — John Cogill
(74) *Attorney, Agent, or Firm* — Christie, Parker & Hale, LLP

(57) ABSTRACT

Wearable camera lens bags and methods of constructing wearable camera lens bags are provided. Embodiments of the lens bags include neoprene panels that define at least one pocket for receiving a camera lens. The panels are stretchable for receiving the camera lens and snugly holding the camera lens within the pocket. The bag also includes a detachable flap that may be interchanged with flaps having other designs to a allow a user to reflect his or her sense of style. When properly worn, the bag ergonomically wraps around the body of the wearer for distributing the weight around the waist. A neoprene laptop sleeve is also provided that protects the laptop with minimal bulk. The sleeve is easily transformed into a shoulder bag via a shoulder strap that may be attached and then detached to return the bag to function as a sleeve. A removable flap may also be attached to the sleeve to allow a user to reflect his or her mood or style via the design of the flap.

20 Claims, 7 Drawing Sheets

(56) References Cited

U.S. PATENT DOCUMENTS

| | | | | | |
|---|---|---|---|---|---|
| 4,440,525 | A | * | 4/1984 | Perla | 405/186 |
| 4,545,414 | A | | 10/1985 | Baum | |
| 4,928,819 | A | | 5/1990 | Jakobsen | |
| D312,530 | S | * | 12/1990 | Gallen et al. | D3/268 |
| 5,040,711 | A | * | 8/1991 | Niederhauser et al. | 224/572 |
| 5,101,974 | A | * | 4/1992 | Alwitt | 206/316.2 |
| 5,205,448 | A | | 4/1993 | Kester et al. | |
| 5,209,385 | A | * | 5/1993 | Ledesma | 224/681 |
| 5,400,102 | A | * | 3/1995 | Alwitt | 396/535 |
| 5,407,111 | A | * | 4/1995 | Lanouette et al. | 224/579 |
| 5,503,476 | A | * | 4/1996 | Hamdan | 383/9 |
| 5,533,558 | A | | 7/1996 | Carey et al. | |
| 5,649,581 | A | * | 7/1997 | Kopel | 150/103 |
| 5,791,481 | A | * | 8/1998 | Thomas | 206/581 |
| 5,842,571 | A | | 12/1998 | Rausch | |
| 6,047,752 | A | * | 4/2000 | Southwick | 150/117 |
| 6,173,837 | B1 | | 1/2001 | Marconi | |
| 6,409,066 | B1 | | 6/2002 | Schneider et al. | |
| D465,328 | S | | 11/2002 | Hassett | |
| D477,710 | S | | 7/2003 | Hillman | |
| D482,865 | S | | 12/2003 | Fair | |
| D483,179 | S | | 12/2003 | Fair | |
| D496,785 | S | | 10/2004 | Hussaini et al. | |
| 7,219,814 | B2 | | 5/2007 | Lown et al. | |
| 7,222,649 | B1 | | 5/2007 | Fox | |
| 7,353,952 | B2 | | 4/2008 | Swartz et al. | |
| 2005/0150800 | A1 | | 7/2005 | Lown et al. | |
| 2005/0259894 | A1 | | 11/2005 | Swartz et al. | |
| 2006/0082246 | A1 | | 4/2006 | Robin et al. | |
| 2006/0151507 | A1 | | 7/2006 | Swartz et al. | |
| 2007/0141876 | A1 | | 6/2007 | Lown et al. | |
| 2007/0175787 | A1 | | 8/2007 | Lown et al. | |
| 2008/0035519 | A1 | | 2/2008 | Swartz et al. | |
| 2008/0073400 | A1 | | 3/2008 | Swartz et al. | |

* cited by examiner

WEARABLE CAMERA LENS BAG AND LAPTOP BAG

CROSS-REFERENCE TO RELATED APPLICATION(S)

This application claims the benefit of U.S. Provisional Patent Application No. 60/999,782, filed on Oct. 18, 2007, the entire content of which is incorporated herein by reference.

FIELD OF THE INVENTION

The present invention relates generally to bags for transporting camera lenses, and more particularly, to a wearable camera lens bag that is ergonomic and functional while allowing a photographer to express his or her sense of style through the bag. The present invention also relates to a computer case for protecting and transporting a portable computer while also allowing the user to express his or her sense of style through the case.

BACKGROUND OF THE INVENTION

Traditional camera lens bags are generally bulky and made of a rigid material to keep the lenses protected from various environmental factors as well as to keep the lenses from breaking during their transportation. Such traditional lens bags, although used to transport the lenses to and from a photo shoot location, are generally not worn during the photo shoot due to their bulkiness and, to some, their unappealing appearance. Rather, the bags are left behind in a particular spot, and the photographer walks back and forth to and from the bag when a change of lens is desired.

With respect to their appearance, many traditional lens bags are made of dark, monochromatic colors that fail to reflect a photographer's personal style. Due to the highly visual profession to which the photographer belongs, it is often important that the clothing and accessories used by the photographer, including the camera lens bag, project the photographer's sense of style.

The photographer may also want to change the look of the bag to coordinate with his or her outfit, based on his or her mood or occasion, and/or to cater to certain types of clientele. Traditional lens bags, however, cannot be changed in terms of their look except by adding different accessories to the bag.

Accordingly, what is desired is a wearable camera lens bag that is ergonomic and functional, while allowing the photographer to express his or her sense of style through the bag.

Laptop computer bags also exist in the prior art for transporting laptop computers and other paraphernalia associated with such computers. Such bags are often bulky due to padding incorporated into the bag for protecting the computer from damage. The many compartments and pockets provided on many traditional bags or transporting laptop accessories also add to their bulkiness. Because of this, laptop bags are many times just as heavy as the laptop computer, making the transportation of laptop computers cumbersome and tiring for many. Traditional laptop bags are also often made of dark, monochromatic colors that fail to reflect a user's personal style.

Accordingly, what is also desired is a case for portable computers that provides protection to the computers with minimal bulk while also allowing the case to be easily transformed into a carrier that can be used to transport the case while allowing a user to reflect his or her mood or style through the case.

SUMMARY OF THE INVENTION

Aspects of embodiments of the present invention are directed toward wearable camera lens bags having an ergonomic shape to hug the body of a user around the waist. A wearable camera lens bag according to one embodiment of the present invention has at least one pocket shaped for receiving a camera lens and having an opening at the top for quickly and easily inserting or removing a lens. Another aspect of embodiments of the present invention is a wearable camera lens bag having a flap covering the openings of the one or more pockets to protect the lenses from dust, moisture, or other environmental factors. Another aspect of embodiments of the present invention is a wearable camera lens bag wherein the flap is interchangeable with other flaps having varying designs or visual appearances so that the user of the camera lens bag can create a style of the bag based on the user's clothing, an occasion, or otherwise. Still another aspect of the present invention is a wearable camera lens bag formed of a stretchable material such that the bag is adapted to conform to various lens shapes and sizes and hold the lenses securely while a user is walking or taking photographs.

A wearable camera lens bag according to an embodiment of the present invention includes: at least one first pouch assembly having an upper edge, a lower edge, and two side edges spaced from each other and extending between the upper and lower edges, the at least one first pouch assembly having a first substantially stretchable panel and a second substantially stretchable panel opposite and joined to the first panel at the lower and side edges, wherein the first panel and the second panel define at least one first pocket therebetween having an opening near the upper edge for receiving a camera lens, the first and second panels being stretchable for receiving the camera lens and exerting compressive force against the camera lens for holding the camera lens substantially snugly within the at least one first pocket; and a flap having a first visual appearance, the flap detachably fastened in association with the at least one first pouch assembly, the flap configured to fold over the opening of the at least one first pocket and hang adjacent on one side of one of the first and second panels, the flap being interchangeable with at least one other flap having another visual appearance different from the first visual appearance.

In one embodiment, the at least one first pocket is sized for snugly holding the camera lens.

In one embodiment, a camera lens bag is configured to substantially hug the body of a wearer of the bag.

According to one embodiment, the first pouch assembly includes three pockets adjacent to one another in a horizontal direction. Two outer ones of the three pockets rest against a front and back torso of the wearer, and a middle one of the three pockets rests against a hip of the wearer.

In one embodiment, the first and second panels are made of neoprene material.

In one embodiment, a camera lens bag further includes at least one line of attachment connecting the first panel to the second panel and creating a plurality of pockets within the first pouch assembly, the at least one line of attachment extending from a first end substantially close to the lower edge to a second end in a direction toward the upper edge.

According to one embodiment, the camera lens bag includes an elastic member substantially close to the second end of the at least one line of attachment. The elastic member allows the first and second panels to be spaced further apart from each other near the upper edge than near the lower edge.

In one embodiment, a camera lens bag further includes a second pouch assembly having an upper edge, a lower edge, and two side edges spaced from each other and extending between the upper edge and the lower edge, the second pouch assembly having a third panel and a fourth panel opposite and joined to each other at the lower and side edges, the third and fourth panels of the second pouch assembly defining at least one second pocket therebetween having an opening near the upper edge for receiving an article into the at least one second pocket, wherein the second pouch assembly is coupled to the at least one first pouch assembly by coupling at least one of the third and fourth panels to at least one of the first and second panels.

According to one embodiment, the first pouch assembly includes three first pockets adjacent to one another in a horizontal direction, and the second pouch assembly includes three second pockets adjacent to one another in the horizontal direction. At least one or more of the first and second pockets may include at least one fastener for holding the pocket in a closed position According to one embodiment, the flap has a first side made of textured neoprene and a second side made of non-textured neoprene. The flap may include a hook and loop fastening device detachably fastening the flap in association with the first and second panels. The flap may also includes a plurality of edges where at least one of the edges is detachably fastened in association with the first and second panels and at least two of the edges are not fastened to the bag.

In one embodiment, the camera lens bag includes a plurality of rings coupled to the at least one first pouch assembly and a shoulder strap with a clip on each end of the strap. Each clip is clipped to one of the rings for configuring the bag to be worn over a shoulder of a user of the bag.

In one embodiment, the lower and side edges of the first panel are respectively attached to the lower and side edges of the second panel without an intermediate bottom panel between the lower edges of the first and second panels and without intermediate side panels between the side edges of the first and second panels.

In one embodiment, the first and second panels lie substantially flat against each other when the at least one first pocket is empty.

In another embodiment of the invention, a wearable bag for carrying camera lenses includes: at least one first pouch assembly having an upper edge, a lower edge, and two side edges spaced from each other and extending between the upper and lower edges, the at least one first pouch assembly comprising a first substantially stretchable panel and a second substantially stretchable panel opposite and joined to the first panel at the lower and side edges; at least one line of attachment connecting the first panel to the second panel and creating a plurality of pockets within the first pouch assembly, the at least one line of attachment extending from a first end substantially close to the lower edge to a second end in a direction toward the upper edge, at least one of the plurality of pockets for receiving a camera lens, the first and second panels stretchable for receiving the camera lens and substantially snugly holding the camera lens within the at least one of the plurality of pockets. The bag also includes a flap having a first visual appearance, the flap detachably fastened in association with the at least one first pouch assembly. The flap is configured to fold over an opening of at least one of the plurality of pockets and hang adjacent on one side of one of the first and second panels. The flap is also interchangeable with at least one other flap having another visual appearance different from the first visual appearance. The bag further includes a shoulder strap for enabling the bag to be worn over a shoulder of a user of the bag. In addition, the bag is configured to substantially hug the body of the wearer of the bag; the lower and side edges of the first panel are respectively attached to the lower and side edges of the second panel without an intermediate bottom panel between the lower edges of the first and second panels and without intermediate side panels between the side edges of the first and second panels; and the first and second panels lie substantially flat against each other when each of the plurality of pockets is empty.

In still another embodiment of the invention, a method for constructing a wearable camera lens bag includes: generating at least one first pouch assembly having an upper edge, a lower edge, and two side edges spaced from each other and extending between the upper and lower edges, the at least one first pouch assembly having a first substantially stretchable panel and a second substantially stretchable panel opposite and joined to the first panel at the lower and side edges, wherein the first and second panels define at least one first pocket therebetween having an opening near the upper edge for receiving a camera lens, the first and second panels being stretchable for receiving the camera lens and substantially snugly holding the camera lens within the at least one pocket; generating a first flap having a first visual appearance; generating a second flap having a second visual appearance; and detachably attaching the first flap having the first visual appearance in association with the at least one first pouch assembly, the flap configured to fold over the opening of the at least one first pocket and hang adjacent on one side of one of the first and second panels, the flap being interchangeable with at least the second flap by removing the first flap and detachably attaching the second flap in association with the at least first pouch assembly.

In one embodiment, a method for constructing a wearable camera lens bag further includes generating a second pouch assembly from third and fourth substantially stretchable panels, wherein the third and fourth panels are joined to one another for creating at least one second pocket for receiving an article into the at least one second pocket; and joining the first pouch assembly to the second pouch assembly by joining a portion of at least one of the first and second panels to a portion of at least one of the third and fourth panels.

According to one embodiment, the present invention is also directed to a case for a portable computer. The case includes a sleeve comprised of substantially stretchable material that substantially hugs a portable computer that is received into the sleeve via an opening on the sleeve; and a flap having a first visual appearance, the flap detachably fastened to the sleeve and configured to fold over the opening of the sleeve and hang adjacent on one side of the sleeve, the flap being interchangeable with at least one other flap having another visual appearance different from the first visual appearance.

According to one embodiment of the invention, the case also includes a plurality of rings coupled to the sleeve; and a shoulder strap having a clip on each end of the strap, each clip for being clipped to one of the rings for configuring the case into a computer transport bag.

According to one embodiment of the invention, the sleeve is made of neoprene material.

According to one embodiment of the invention, the flap includes at least one pocket.

According to one embodiment of the invention, the sleeve has an upper edge, lower edge, and two side edges spaced from each other and extending between the upper and lower edges, the sleeve having a first substantially stretchable panel and a second substantially stretchable panel opposite and coupled to the first panel, wherein at least one of the first and second panels includes an exterior pocket.

BRIEF DESCRIPTION OF THE DRAWINGS

These and other features, aspects, and advantages of the present invention will become better understood with regard to the following description, appended claims, and accompanying drawings where:

DETAILED DESCRIPTION

According to an embodiment of the present invention, a wearable camera lens bag is provided which is designed to be worn comfortably over the shoulder during a photo shoot. According to another embodiment of the invention, the straps of the bag may be adjusted to allow the bag to be worn across the chest as a messenger bag. Wearing the bag in either mode permits quick and easy access to camera lenses. The wearer is able to reach down into the bag and remove a lens or place it back into the bag in one fluid motion.

According to one embodiment of the invention, the bag has an ergonomic shape that hugs the body when properly worn, and distributes the weight of the bag around the waist and/or hip of the wearer. The size, material, and thinness of the bag contribute to the ergonomic shape. Such ergonomic shape allows the wearer to feel sleek and mobile when wearing the bag instead of clumsy and bulky. The slim design also allows the bag to fold flat when not in use for easy transportation and storage.

Figure 2:
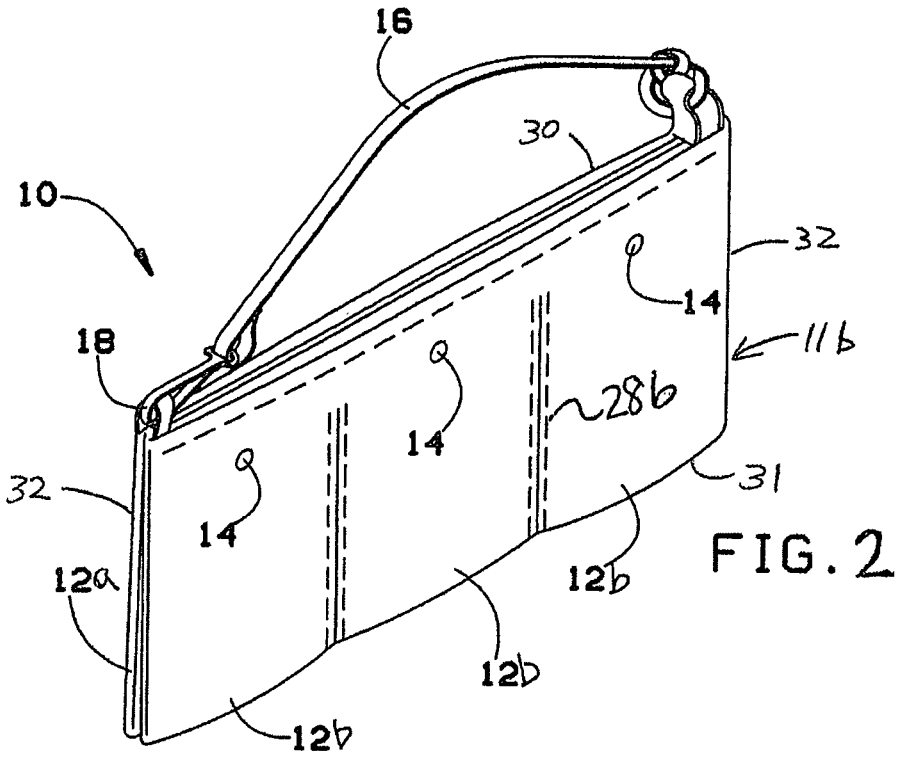
FIG. 2 is a perspective view of the back of a wearable camera lens bag according to one embodiment of the invention.
Figure 1:
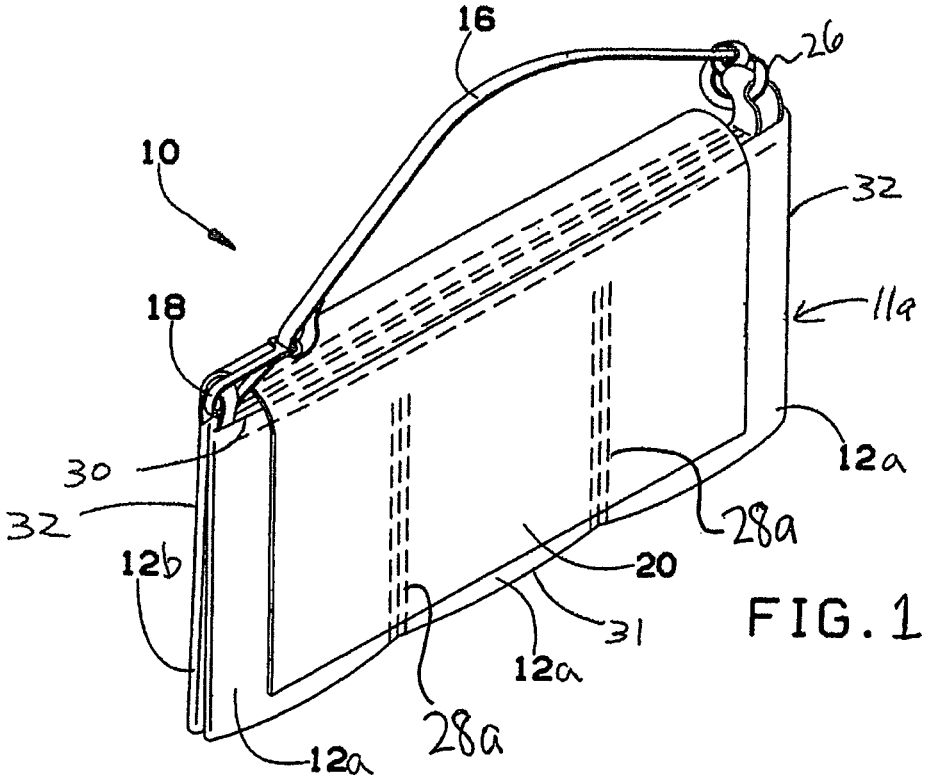
FIG. 1 is a perspective view of the front of a wearable camera lens bag with a cover/flap according to one embodiment of the invention.
Figure 3:
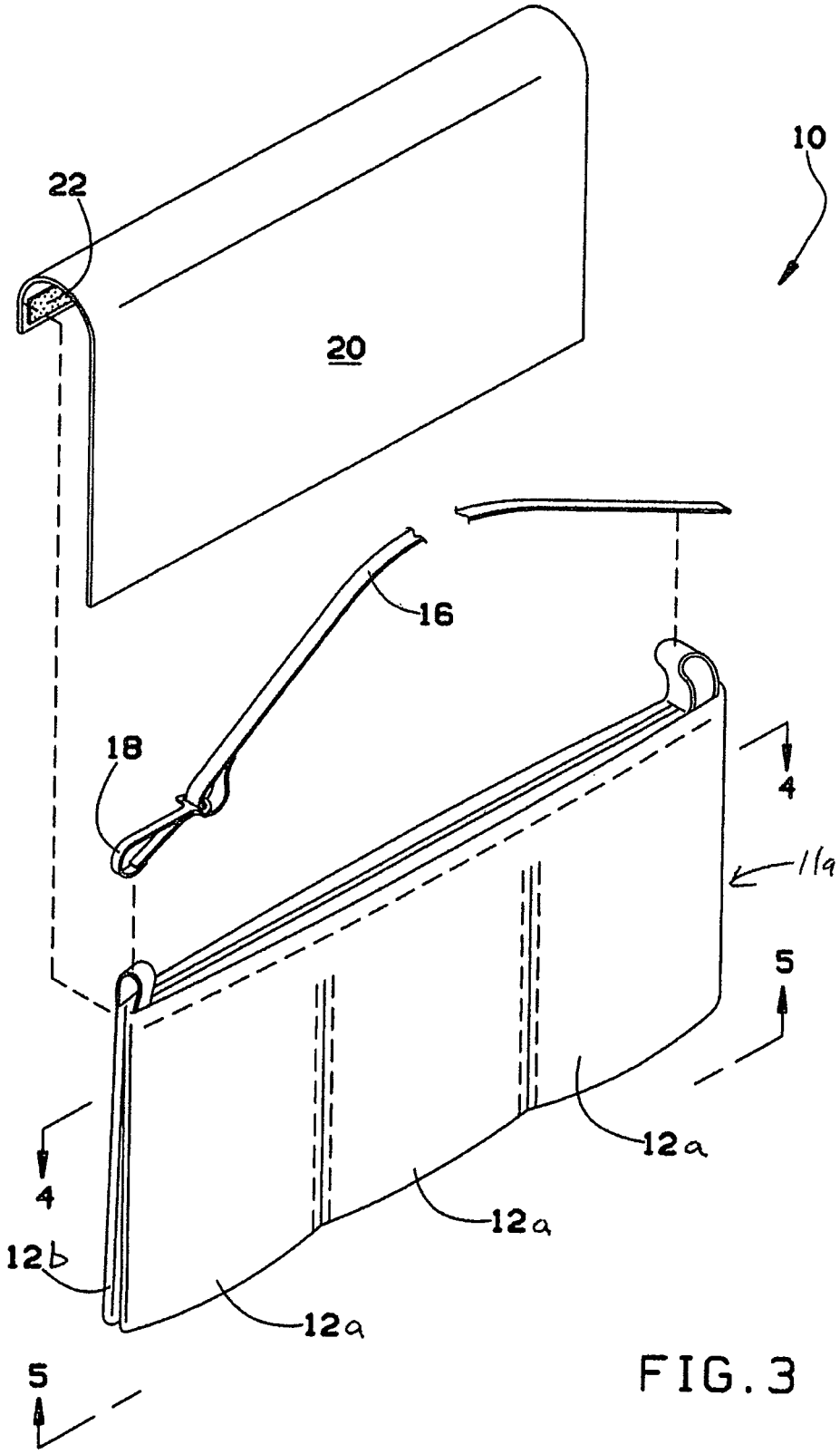
FIG. 3 is an exploded view of a wearable camera lens bag according to one embodiment of the invention.

FIGS. 1 and 2 are respectively front and back perspective views of a wearable camera lens bag 10 according to one embodiment of the invention. According to one embodiment, the bag 10 is made of a lightweight, wetsuit-grade neoprene material aimed to protect the camera lenses during their transportation and use, and further protect the lenses from the environment. The exterior of the bag is made of textured neoprene for abrasion resistance. The interior of the bag is made of basic, non-textured neoprene. Together, the neoprene material may be provided having various thicknesses to provide padding to the contents of the bag. Because neoprene alone is used according to one embodiment for providing the padding, the bag remains flexible to wrap around the body of the wearer when in use.

The neoprene material is also stretchable and has a springy, elastic consistency which provides a snug fit for the contents of the bag. The elastic properties of the neoprene are invoked for allowing the neoprene material to stretch to be conformable to the shape of a camera lens or other items in the bag so that the lens or the other items are held snugly within a pocket of the bag 10 to prevent them to fall out even as the wearer moves about rapidly and in various positions during a photo shoot. Alternatively, the bag 10 may be constructed of any other suitable material having the properties described above.

According to one embodiment of the invention, the bag 10 includes a first pouch assembly 11*a* and a second pouch assembly 11*b* coupled to the first pouch assembly 11*a*. Alternatively, the bag 10 may include only one pouch assembly, or the bag 10 may include three or more pouch assemblies coupled to each other. Each of the pouch assemblies 11*a*, 11*b* has an upper edge 30, a lower edge 31, and two side edges 32 spaced from each other. The two side edges 32 extend between and are substantially perpendicular to the upper edge 30 and the lower edge 31. For example, in the embodiment illustrated in FIGS. 1 and 2, each of the pouch assemblies 11*a*, 11*b* is substantially rectangular in shape.

Figure 4:
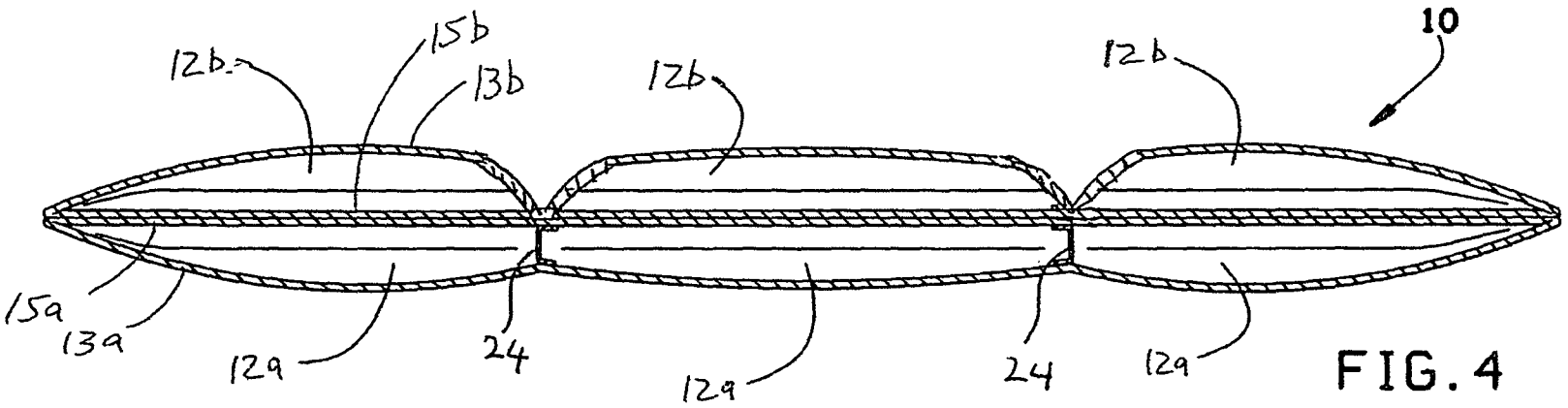
FIG. 4 is a sectional view of the wearable camera lens bag of FIG. 3 taken along line 4-4 according to one embodiment of the invention.
Figure 5:
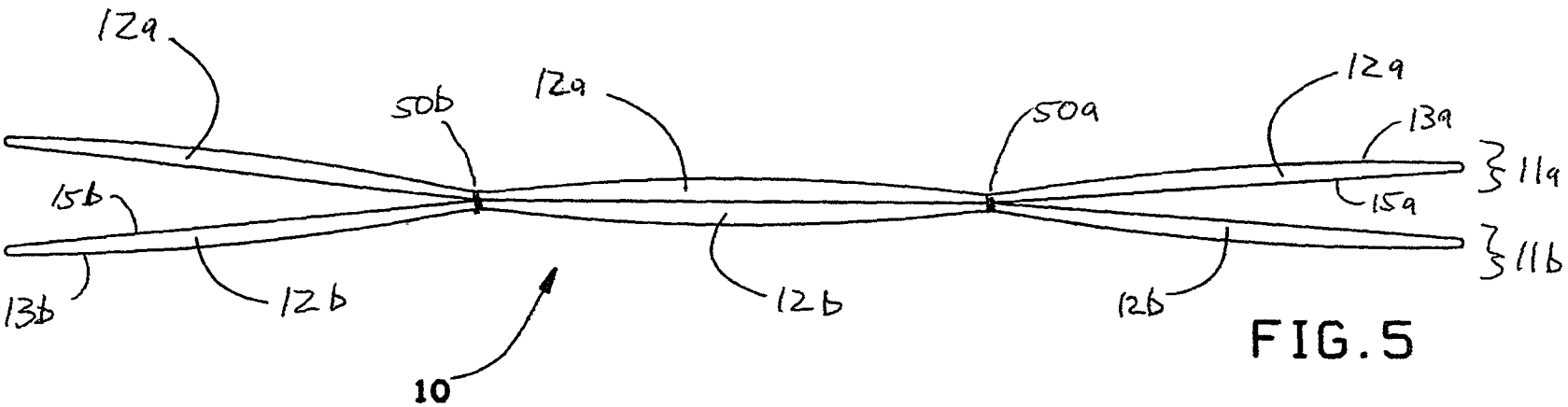
FIG. 5 is a bottom view of the wearable camera lens bag of FIG. 3 taken along line 5-5 according to one embodiment of the invention.

Further, with reference to FIGS. 4 and 5, the first pouch assembly 11*a* includes a first panel 13*a* and a second panel 15*a* sewn or otherwise joined together at the lower edge 31 and at the two side edges 32 without any intervening bottom or side panels. This allows the panels to lie flat against each other when the pockets are empty. Similarly, the second pouch assembly 11*b* includes a first panel 13*b* and a second panel 15*b* sewn or otherwise joined together at the lower edge 31 and at the two side edges 32. The upper edges of the first panel 13*a*, 13*b* and second panel 15*a*, 15*b* are not sewn together to allow receipt of camera lenses and other paraphernalia into the space created between the first and second panels. According to one embodiment, the space is divided into one or more pockets sized for snugly holding camera lenses or other items in place. Specifically, the first panels 13*a*, 13*b* and the second panels 15*a*, 15*b* on either side of the pockets are stretchable to conform to the shape of the lens or other item to snugly hold the lens or other item in place.

According to one embodiment of the invention, the bag 10 includes six individual pocket compartments 12*a*, 12*b*: three front pockets 12*a* in the first pouch assembly 11*a* and three back pockets 12*b* in the second pouch assembly 11*b*. The three front pockets 12*a* are defined via stitching 28*a* (FIG. 1) that measures, for example, approximately 7 inches (17.8 cm) in length from the bottom of the bag 10. Alternatively, the stitching 28*a* may stop short of the bottom of the bag 10. Also, the stitching 28*a* may be a continuous line of attachment or the stitching 28*a* may be intermittent approximately along the lines shown in FIG. 1. According to one embodiment, the stitching does not continue to the top of the bag. Instead, there is a spacing of approximately 2 inches (5.1 cm) from the top of the bag and the stitching 28*a*. Ripstop tape may be used to reinforce the stitching 28*a* so that it does not tear during use. According to one embodiment, stitching 28*b* for the three back pockets 12*b* is similar or the same as the stitching 28*a* for the front pockets 12*a*. Alternatively, the stitching 28*a*, 28*b* may be any other suitable line of attachment connecting the first panel(s) to the second panel(s) to divide one or more of the pouch assemblies into a plurality of pockets for receiving camera lenses or other items.

In one embodiment, the first pouch assembly 11*a* is coupled to the second pouch assembly 11*b* by joining the second panels 15*a*, 15*b* to one another at the upper edge 30 with, for example, LYCRA binding (LYCRA is a registered trademark of Invista North America S.A.R.L. Corporation). Additionally, the lower edges 31 of the first and second pouch assemblies 11*a*, 11*b* may be sewn together so that the two pouch assemblies 11*a*, 11*b* are continuously or intermittently joined together along all or a portion of the lower edges 31. According to one embodiment, the first and second pouch assemblies 11*a*, 11*b* are sewn together via stitchings 50*a*, 50*b* (FIG. 5) which extend in length over a portion of stitchings 28*a*, 28*b*. Further, in another embodiment, the side edges 32 of the two pouch assemblies 11*a*, 11*b* may be continuously or intermittently sewn together along all or a portion of the side edges 32 on the inside or outside. For example, the second panel 15*a* of the first pouch assembly 11*a* may be joined to the second panel 15*b* of the second pouch assembly 11*b* at one or both of the two side edges 32.

According to one embodiment, each of the panels 13*a*, 13*b*, 15*a*, 15*b* has a generally rectangular shape having a width of approximately 17.25 inches (43.8 cm), a height of approximately 9.25 inches (23.5 cm), and a thickness of approximately 0.12 inches (3 mm). These four panels contribute a total of 12 mm to the thickness of the bag, providing the slim and ergonomic design of the bag. Alternatively, other embodiments of the bag may have panels having other suitable shapes and sizes. Further, in one embodiment, the bag 10 includes a stiffener between the first and second pouch assemblies 11*a*, 11*b*. The stiffener adds rigidity to the bag 10 that allows the top edge of the panels from collapsing to the bottom edge while still providing the flexibility for allowing the bag to wrap around the waist of the wearer. The stiffener may be formed of a sheet of plastic material having a height and a width substantially equal to those of the panels, and a thickness of approximately 0.008 inches (0.2 mm). Any other materials that allow the bag to substantially hug the waist of the wearer are also contemplated for the stiffener.

Figure 6:
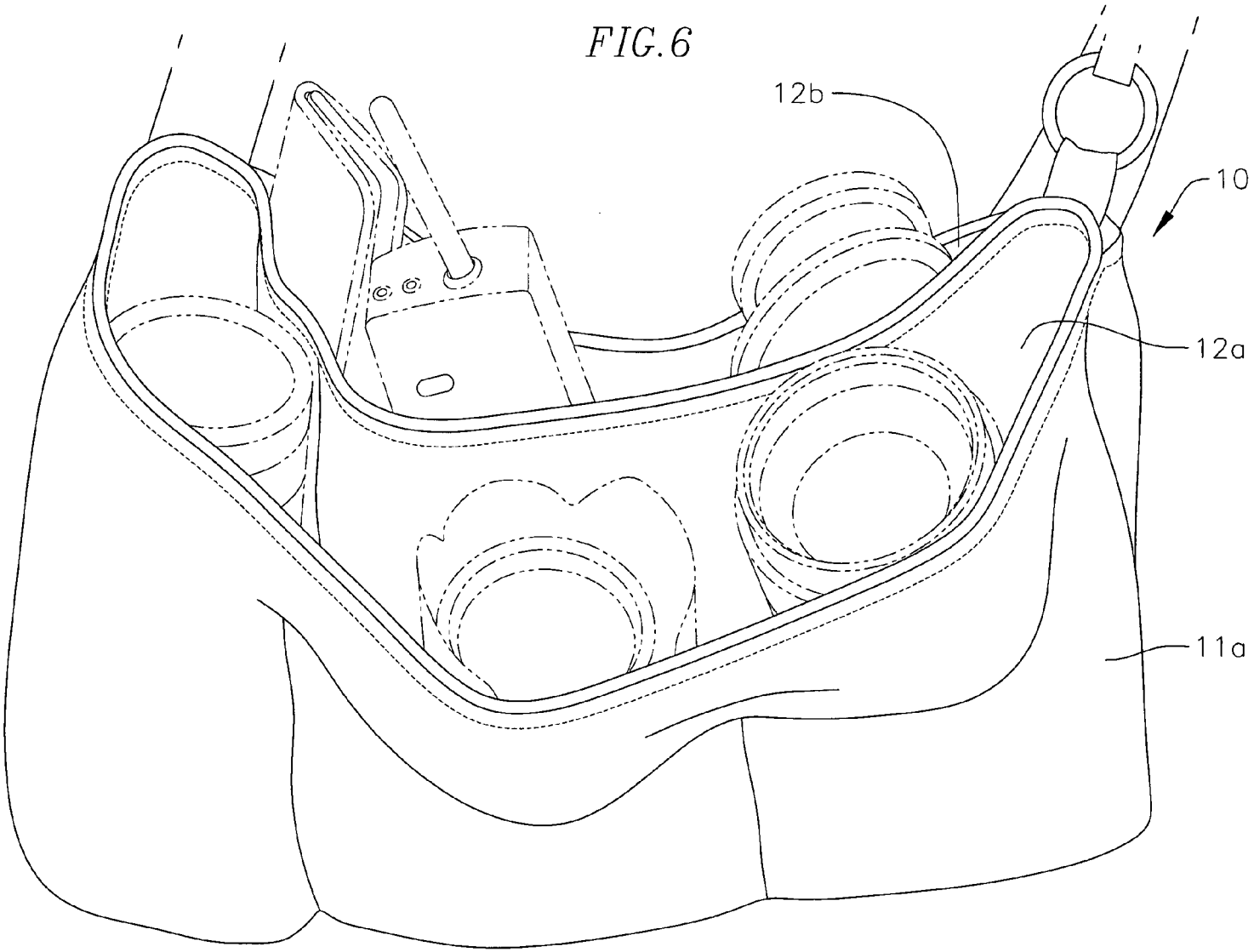
FIG. 6 is a perspective view of a wearable camera lens bag according to one embodiment of the invention containing camera lenses.

As is illustrated in FIG. 6, the front pockets 12*a* are preferably configured to store lenses while the back pockets 12*b* that are against a wearer's body may be used to store smaller camera components and other miscellaneous materials such as, for example, flashcards, batteries, phones, and the like. In this regard, the openings of the back pockets 12*b* may be held closed via fasteners 14 (see FIG. 2) to prevent the smaller components from falling out. The fasteners 14 may be snaps, or alternatively, hook and loop fasteners, magnetic fastening devices, or any other suitable device for holding the openings of the back pockets 12*b* in a closed position. Of course, if desired, the back pockets 12*b* may also be used to store some types of lenses.

Figure 8:
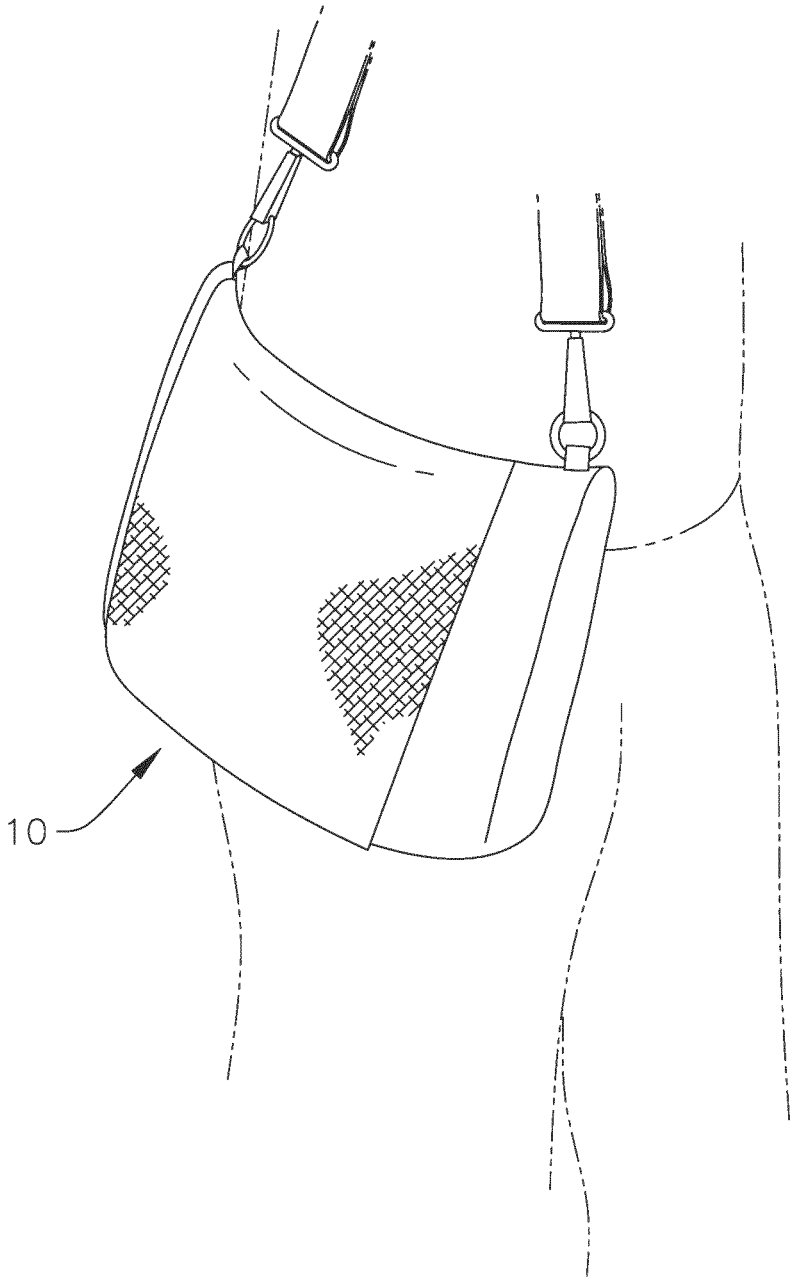
FIG. 8 is a perspective view of a camera lens bag substantially wrapped around the body of a wearer.

According to one embodiment of the invention, the front pockets 12*a* and the back pockets 12*b* have substantially the same dimensions. Specifically, according to one embodiment, the centermost front and back pockets 12*a*, 12*b* are approximately 6 inches (15.2 cm) wide and approximately 4 inches (10.2 cm) deep, while the outermost front and back pockets 12*a*, 12*b* are approximately 5.5 inches (14.0 cm) wide and approximately 4 inches (10.2) deep. These approximate dimensions, as well as the flexible/moldable neoprene material used and other described configurations of the bag 10, allow the bag 10 to ergonomically wrap around the waist of a person when worn, distributing the weight around the waist of the wearer. That is, as shown in the picture of FIG. 8, the outermost pockets each respectively rest against the front and back of a wearer's torso, while the center pocket rests against the side hip.

The front pockets 12*a* have a snug bottom (see FIG. 5) and an extendible open top (see FIG. 4) to accommodate a lens with a wider hood. In this regard, two elastic strips 24 (also referred to as lens extenders) are sewn inside the bag 10 at the boundaries of the centermost front pocket 12*a* and the two outermost front pockets 12*a* above the stitchings 28*a*, as is illustrated in FIG. 4. In one embodiment, each of the elastic strips 24 is approximately 2 inches (5.1 cm) long and approximately 1.5 inches (3.8 cm) wide. According to one embodiment of the invention, the elastic strips 24 are pinched at the bottom to ensure that the front pockets 12*a* remain snug at the bottom. Thus, when the lenses are pushed all the way inside and down into the pocket, the springy, stretchable consistency of the neoprene material allows the neoprene to act as a glove that conforms to the shape of the lenses and keeps the lenses snugly in place, preventing them from falling out despite the motion of the wearer during a photo shoot, while at the same time accommodating the wide hood of some lenses via the lens extenders 24. That is, the snug bottom along with the neoprene material that stretches to receive the lens and then retracts to exert a compressive force on the lens allows the lens to be snugly held in place within the pocket. For example, the panels 13*a*, 15*a* of the first pouch assembly 11*a* are conformable to the shape of a camera lens or other item such that the lenses or other items are held snugly within one or more of the pockets 12*a*. In other embodiments, the back pockets 12*b* may also include elastic strips (lens extenders) similar to the elastic strips 24 described above with respect to the front pockets 12*a*.

Further, the pouch assemblies 11*a*, 11*b* are conformable such that a lens or other item can be held snugly within one or more of the pockets 12*a*, 12*b* because the first panels 13*a*, 15*a* are joined directly to the second panels 13*b*, 15*b* without any intermediate panels therebetween. That is, as shown in FIGS. 4 and 5, the pouch assemblies 11*a*, 11*b* do not have any bottom panel or side panels. For this reason, the first panels 13*a*, 15*a* are held close to the second panels 13*b*, 15*b* where they are respectively joined, thus providing a snug fit to a camera lens or other item in one of the pockets 12*a*, 12*b* defined by each pair of a first panel and a second panel. Additionally, because the first panels 13*a*, 15*a* are joined directly to the second panels 13*b*, 15*b* without any intermediate panels therebetween, the bag 10 is adapted to lie substantially flat when all of the pockets 12*a*, 12*b* are empty. This is advantageous for efficient storage or transportation of the bag 10.

The bag 10 further includes a shoulder strap 16 tied at a first end of the bag and attached to a second end via a shoulder strap clip 18. The shoulder strap 16 may be formed of nylon or any other suitable material and may have any suitable length and width, such as 36 inches (91 cm) and 1.5 inches (3.8 cm), respectively, in one embodiment. According to one embodiment of the invention, a metal O-ring 26 attached to the second end of the bag receives the shoulder strap clip 18. Alternatively, as is illustrated in FIGS. 1 and 2, the shoulder strap clip 18 and the metal O-ring 26 may be attached at opposite ends of the bag. The metal O-ring 26 may also be used to attach other components, such as, for example, keys, flashcards, other clips, and the like. According to one embodiment, the shoulder strap 16 includes an adjuster for adjusting the length of the shoulder strap 16.

According to one embodiment of the invention, the bag 10 includes an interchangeable cover or flap 20 which is removably attached to a top portion of the bag via any fastening mechanism known in the art, such as, for example, a hook and loop fastening device 22 such as a VELCRO strip (VELCRO is a registered trademark of Velcro Industries). For example, the cover or flap 20 may be removably attached to one side of the second panel 15*b* of the second pouch assembly 11*b*. The cover or flap 20 may alternatively be attached to the second panel 15*a* of the first pouch assembly 11*a* or the first panel 13*b* of the second pouch assembly 11*b*.

The cover 20 provides an extra layer of protection and functionality to the bag. That is, the cover 20 folds over at least the top of the first pouch assembly 11*a* and covers the openings of the front pockets 12*a*, protecting the lenses from dust, precipitation, and other environmental factors. That is, the cover 20 folds over the top and the openings of the first pouch assembly 11*a* and hangs adjacent one side of the assembly when the bag is in a closed position. The flap 20 is then lifted open to access the contents of the front pockets 12*a*. Furthermore, the soft, non-textured neoprene inside of the cover allows the cover 20 to be removed and used to clean the lens, or as a blanket that covers the lens.

According to one embodiment, the cover 20 is substantially square in shape having sides of approximately 13 inches (33 cm) and a thickness of approximately 0.12 inches (3 mm). The VELCRO strip or other fastening device 22 may extend the entire width at or near one edge of the cover 20 or the fastening device may be located in more than one location on the cover. The cover 20 may also include edging, such as grosgrain ribbon, on the three edges not having the fastening device 22. According to alternative embodiments, the cover 20 may also include pockets sized for accessories such as phones, business cards, and other lightweight items.

According to one embodiment of the invention, the removability of the cover allows the look of the bag to be easily changed to cater to a particular style, mood, or occasion. That is, the bag 10 and its wearer may project different images for different occasions by simply interchanging the existing cover 20 with a different cover.

Figure 7:
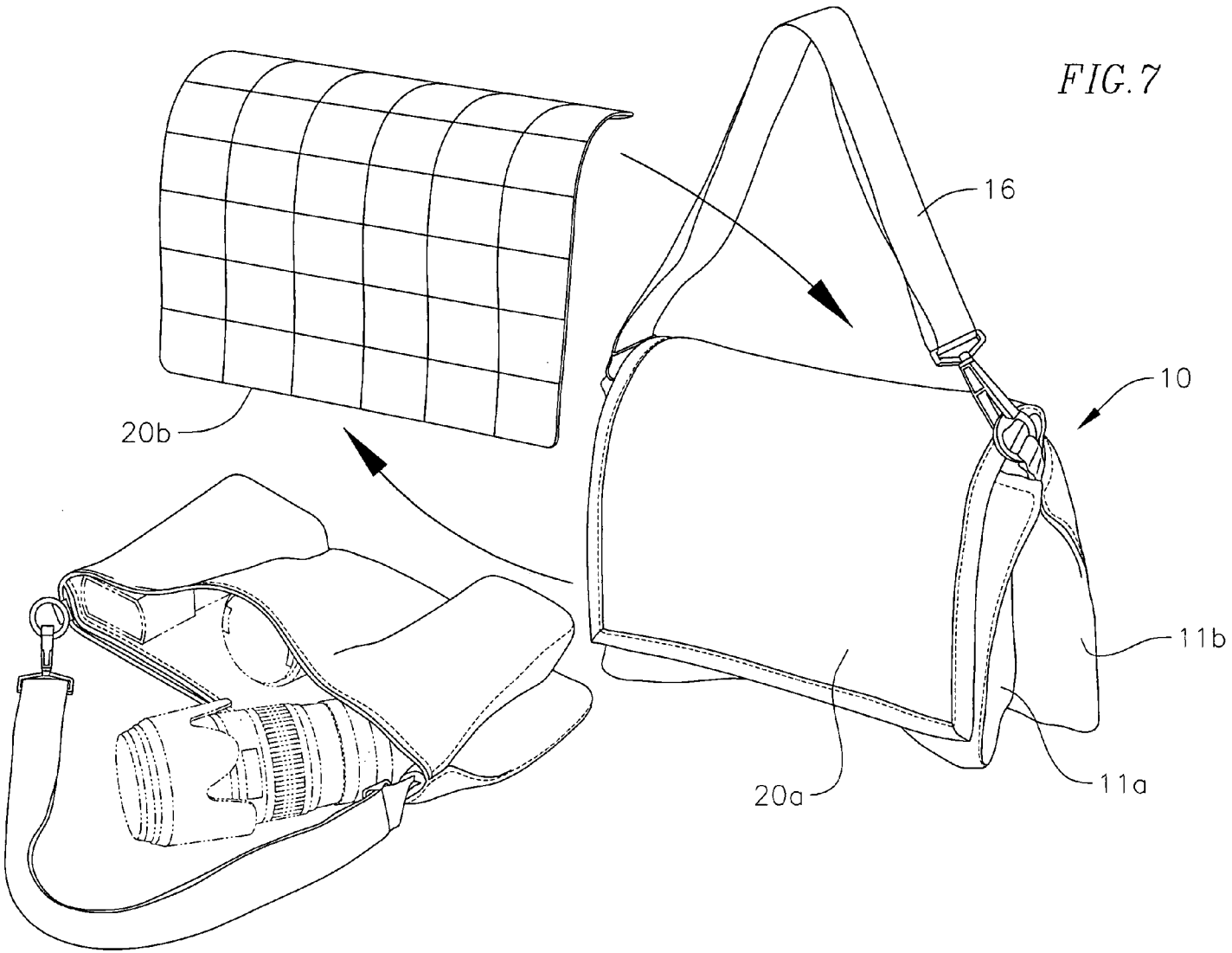
FIG. 7 is a perspective view of a wearable camera lens bag according to one embodiment of the invention having interchangeable covers.

According to one embodiment of the invention, various covers having different colors and patterns are provided for allowing an existing cover to be replaced with a different cover. Specifically, an existing cover 20*a* is detached from the bag 10, and a cover 20*b* having a different color and/or pattern is attached to the bag via the fastening mechanism, as is illustrated in FIG. 7. The varying covers allow the photographer to project a desired image, and to change such image as often as needed.

Although the above embodiments have been described in terms of a camera lens bag, a person of skill in the art should recognize that the ergonomic wearable bag may be used for transporting other goods as will be apparent to a person of skill in the art.

According to another embodiment of the invention, the neoprene material described above with references to the camera lens bag is used to create a snug-fitting laptop sleeve that protects the laptop or other portable electronic device from dents, scratches, and the like, with minimal bulk. The neoprene material is preferably a textured neoprene for extra durability. However, a non-textured neoprene may also be used.

The sleeve with the laptop computer may be easily inserted into a briefcase or other bag for transporting the laptop without requiring a separate, traditional, laptop bag, while also allowing the laptop to be protected during the transportation. According to one embodiment of the invention, the laptop sleeve is also easily transformed into a shoulder bag for convenient, non-bulky transportation of laptops. In this regard, the sleeve provides a low-profile attachment mechanism for attaching a shoulder strap to the sleeve if the sleeve is to function as a non-bulky shoulder bag. When the strap is removed, the bag returns to function as a sleeve.

Figure 9:
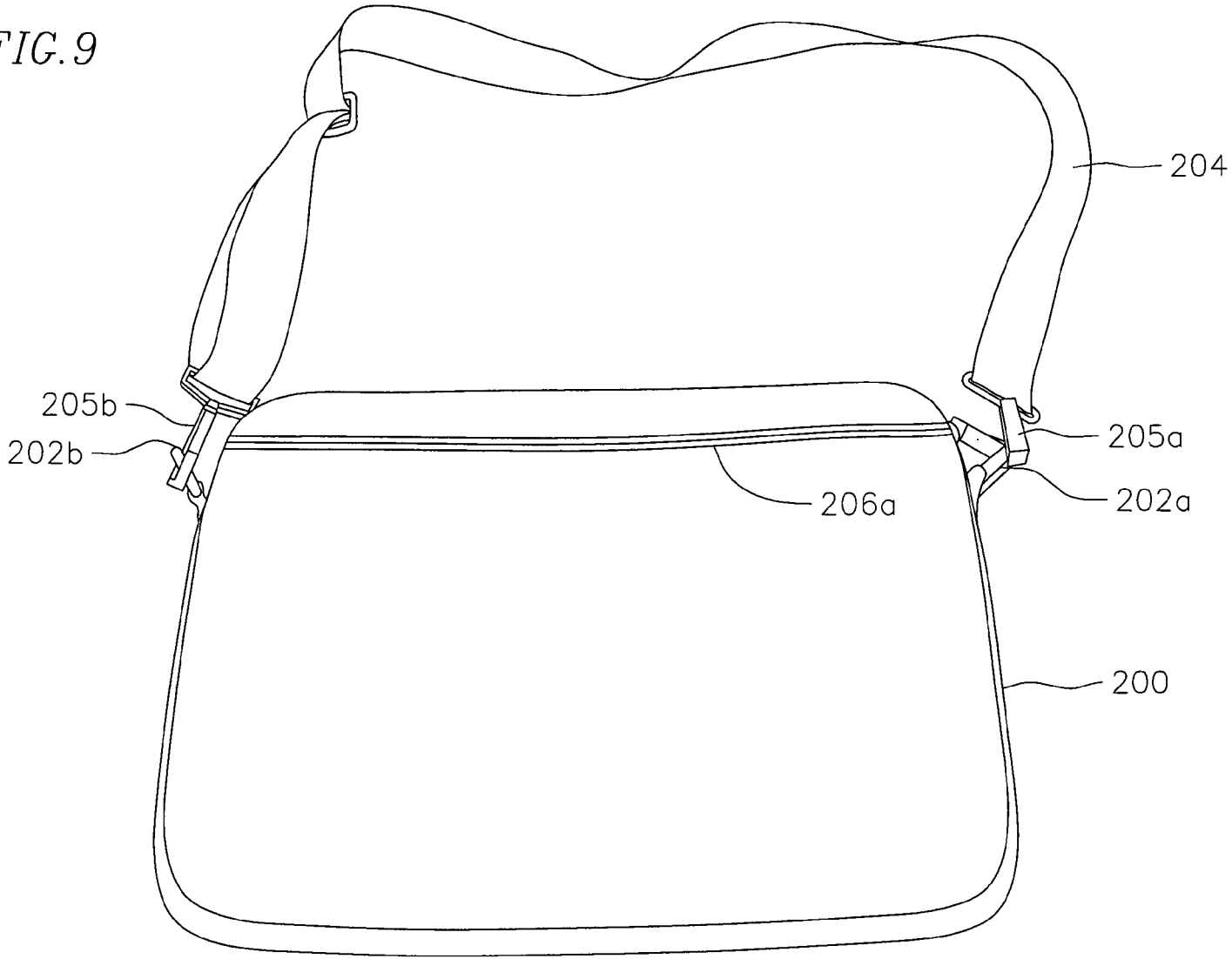
FIG. 9 is a perspective view of a front of a laptop sleeve with shoulder straps attached according to one embodiment of the invention.

FIG. 9 is a perspective view of the front of a laptop sleeve with shoulder straps attached according to one embodiment of the invention. In the illustrated embodiment, the laptop sleeve 200 is constructed with at least two neoprene panels that have substantially the same height and length as a laptop computer that is to be inserted into the sleeve. According to one embodiment of the invention, at least one of the panels stretches to receive the laptop computer and snugly holds the computer within the sleeve. According to one embodiment of the invention, the configuration of the sleeve leaves no room for the computer to slide around within the sleeve.

The sleeve 200 includes metal O-rings 202*a*, 202*b* for transforming the sleeve into a shoulder bag. In this regard, a shoulder strap 204 attaches to the hooks 202*a*, 202*b* via clips 205*a*, 205*b* and allows the sleeve to be carried over the shoulder or across the chest of the wearer in a messenger-bag style. When the shoulder strap is removed, the bag returns to be a sleeve 200, and may be carried as a notebook or inserted into another bag for transportation.

The sleeve 200 further includes a pocket on each of two exterior panels that form the body of the sleeve, and spans the width of the sleeve. FIG. 9 show one such exemplary pocket 206*a*.

As with the camera lens bag embodiment, the sleeve has minimum thickness which allows the sleeve to lay flat when empty. Thus, unlike a traditional bulky laptop bags, the sleeve according to the present embodiment has a slim design for easy transportation and storage.

Although this invention has been described in certain specific embodiments, those skilled in the art will have no difficulty devising variations which in no way depart from the scope and spirit of the present invention. It is therefore to be understood that this invention may be practiced otherwise than is specifically described. Thus, the present embodiments of the invention should be considered in all respects as illustrative and not restrictive, the scope of the invention to be indicated by the appended claims and their equivalents rather than the foregoing description.

What is claimed is:

1. A wearable camera lens bag comprising:

at least one first pouch assembly having an upper edge, a lower edge, and two side edges spaced from each other and extending between the upper and lower edges, the at least one first pouch assembly including a first substantially stretchable panel and a second substantially stretchable panel opposite and joined to the first panel at the lower and side edges, and at least one elastic member between the first and second panels and defining at least one first pocket therebetween having an opening near the upper edge for receiving a camera lens, the first and second panels and the at least one elastic member being stretchable for receiving the camera lens within the at least one first pocket, the at least one elastic member defining a side of the at least one first pocket that is between the two side edges of the at least one first pouch assembly, the at least one first pouch assembly further including at least one line of stitching connecting the first and second panels and defining the side of the at least one first pocket together with the at least one elastic member, the at least one line of stitching extending from a first end substantially close to the lower edge to a terminal second end spaced apart from the upper edge, each of the at least one elastic member being substantially close to the second end of a respective one of the at least one line of stitching and being spaced apart from the first end of the respective one of the at least one line of stitching in a direction toward the upper edge, wherein the at least one elastic member allows the first and second panels to be spaced further apart from each other near the upper edge than near the lower edge.

2. The camera lens bag of claim 1 further comprising a second pouch assembly having an upper edge, a lower edge, and two side edges spaced from each other and extending between the upper edge and the lower edge, the second pouch assembly having a third panel and a fourth panel opposite and joined to each other at the lower and side edges, the third and fourth panels of the second pouch assembly defining at least one second pocket therebetween having an opening near the upper edge for receiving an article into the at least one second pocket, wherein the second pouch assembly is coupled to the at least one first pouch assembly by coupling at least one of the third and fourth panels to at least one of the first and second panels.

3. The camera lens bag of claim 2, wherein the at least one first pouch assembly includes three first pockets adjacent to one another in a horizontal direction, and the second pouch assembly includes three second pockets adjacent to one another in the horizontal direction.

4. The camera lens bag of claim 3, wherein one or more of the first and second pockets includes at least one fastener for holding the pocket in a closed position.

5. The camera lens bag of claim 1, further comprising a flap having a first visual appearance, the flap detachably fastened in association with the at least one first pouch assembly, the flap configured to fold over the opening of the at least one first pocket and hang adjacent on one side of one of the first and second panels, the flap being interchangeable with at least one other flap having another visual appearance different from the first visual appearance.

6. The camera lens bag of claim 5, wherein the flap has a first side made of textured neoprene and a second side made of non-textured neoprene.

7. The camera lens bag of claim 5, wherein the flap includes a hook and loop fastening device detachably fastening the flap in association with the first and second panels.

8. The camera lens bag of claim 5, wherein the flap comprises a plurality of edges and at least one of the edges is detachably fastened in association with the first and second panels and at least two of the edges are not fastened to the bag.

9. The camera lens bag of claim 1, wherein the bag is configured to substantially hug the body of a wearer of the bag.

10. The camera lens bag of claim 9, wherein the first pouch assembly includes three pockets adjacent to one another in a horizontal direction, wherein two outer ones of the three pockets rest against a front and back torso of the wearer, and a middle one of the three pockets rests against a hip of the wearer.

11. The camera lens bag of claim 10, wherein the two outer pockets have a substantially same width that is smaller than a width of the middle pocket.

12. The camera lens bag of claim 9, further comprising a stiffener member configured to add rigidity to the camera lens bag, the stiffener member having a size that is substantially equal to a size of the first and second panels.

13. The camera lens bag of claim 1, wherein lower and side edges of the first panel are respectively attached to lower and side edges of the second panel without an intermediate bottom panel between the lower edges of the first and second panels and without intermediate side panels between the side edges of the first and second panels.

14. The camera lens bag of claim 13, wherein the first and second panels lie substantially flat against each other when the at least one first pocket is empty.

15. The camera lens bag of claim 13, wherein the lower edge is substantially straight.

16. The camera lens bag of claim 1, wherein the first and second panels are stretchable for exerting compressive force against the camera lens for holding the camera lens snugly within the at least one first pocket, and the at least one first pocket is sized for snugly holding the camera lens.

17. The camera lens bag of claim 1, wherein the first and second panels are made of neoprene material.

18. The camera lens bag of claim 1 further comprising a plurality of rings coupled to the at least one first pouch assembly and a shoulder strap with a clip on each end of the strap, each clip for being clipped to one of the rings for configuring the bag to be worn over a shoulder of a user of the bag.

19. A wearable bag for carrying camera lenses, the bag comprising:

at least one first pouch assembly having an upper edge, a lower edge, and two side edges spaced from each other and extending between the upper and lower edges, the at least one first pouch assembly comprising a first substantially stretchable panel and a second substantially stretchable panel opposite and joined to the first panel at the lower and side edges;

at least one elastic member between the first panel and the second panel and creating a plurality of pockets within the first pouch assembly, at least one of the plurality of pockets for receiving a camera lens, the first and second panels and the at least one elastic member stretchable for receiving the camera lens within the at least one of the plurality of pockets, the at least one elastic member defining a side of the at least one of the plurality of pockets that is between the two side edges of the at least one first pouch assembly;

at least one line of stitching connecting the first and second panels and defining the side of the at least one of the plurality of pockets together with the at least one elastic member, the at least one line of stitching extending from a first end substantially close to the lower edge to a terminal second end spaced apart from toward the upper edge, each of the at least one elastic member being substantially close to the second end of a respective one of the at least one line of stitching and being spaced apart from the first end of the respective one of the at least one line of stitching in a direction toward the upper edge, wherein the at least one elastic member allows the first and second panels to be spaced further apart from each other near the upper edge than near the lower edge;

a flap having a first visual appearance, the flap detachably fastened in association with the at least one first pouch assembly, the flap configured to fold over an opening of at least one of the plurality of pockets and hang adjacent on one side of one of the first and second panels, the flap being interchangeable with at least one other flap having another visual appearance different from the first visual appearance; and a shoulder strap for enabling the bag to be worn over a shoulder of a user of the bag, wherein:

the bag is configured to substantially hug the body of the wearer of the bag;

the lower and side edges of the first panel are respectively attached to the lower and side edges of the second panel without an intermediate bottom panel between the lower edges of the first and second panels and without intermediate side panels between the side edges of the first and second panels; and the first and second panels lie substantially flat against each other when each of the plurality of pockets is empty.

20. The camera lens bag of claim 19 further comprising a second pouch assembly having an upper edge, a lower edge, and two side edges spaced from each other and extending between the upper edge and the lower edge, the second pouch assembly having a third panel and a fourth panel opposite and joined to each other at the lower and side edges, the third and fourth panels of the second pouch assembly defining at least one second pocket therebetween having an opening near the upper edge for receiving an article into the at least one second pocket, wherein the second pouch assembly is coupled to the at least one first pouch assembly by coupling at least one of the third and fourth panels to at least one of the first and second panels.

* * * * *